US008515012B2

(12) United States Patent
Koppisetty et al.

(10) Patent No.: US 8,515,012 B2
(45) Date of Patent: Aug. 20, 2013

(54) X-RAY TUBE WITH HIGH SPEED BEAM STEERING ELECTROMAGNETS

(75) Inventors: Kalyan Koppisetty, Milwaukee, WI (US); Ethan James Westcot, Milwaukee, WI (US); Carey Shawn Rogers, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 253 days.

(21) Appl. No.: 12/986,880

(22) Filed: Jan. 7, 2011

(65) Prior Publication Data

US 2012/0177185 A1 Jul. 12, 2012

(51) Int. Cl.
*H01J 35/06* (2006.01)

(52) U.S. Cl.
USPC ..... 378/137; 378/136

(58) Field of Classification Search
USPC ..... 378/91, 93, 101, 113, 119, 121, 135–137, 378/145, 210; 315/160, 164, 167, 168, 170, 315/218, 346, 535
See application file for complete search history.

(56) References Cited

U.S. PATENT DOCUMENTS

| | | | | |
|---|---|---|---|---|
| 5,131,376 | A * | 7/1992 | Ward et al. | 123/598 |
| 6,055,294 | A | 4/2000 | Foerst et al. | |
| 6,292,538 | B1 | 9/2001 | Hell et al. | |
| 2008/0198970 | A1 * | 8/2008 | Kirshner et al. | 378/137 |
| 2010/0020937 | A1 | 1/2010 | Hautmann et al. | |

OTHER PUBLICATIONS

C.R. Sullivan, "Optimal Choice for Number of Strands in a Litz-Wire Transformer Winding", Mar. 1999, IEEE, Transactions on Power Electronics vol. 14, No. 2, pp. 283-291.*

* cited by examiner

*Primary Examiner* — Anastasia Midkiff
(74) *Attorney, Agent, or Firm* — Fletcher Yoder, P.C.

(57) ABSTRACT

The present embodiments relate to efficient electron beam steering within X-ray tubes, for example X-ray tubes used in CT imaging. In one embodiment, and X-ray tube with enhanced electron beam steering is provided. The X-ray tube includes an electron beam source, a target configured to generate X-rays when impacted by an electron beam from the electron beam source, and a steering magnet assembly having a plurality of ferrite cores and a plurality of litz wire coils wound on the ferrite cores.

19 Claims, 4 Drawing Sheets

X-RAY TUBE WITH HIGH SPEED BEAM STEERING ELECTROMAGNETS

BACKGROUND OF THE INVENTION

The subject matter disclosed herein relates to X-ray tubes and, in particular, to electron beam steering within an X-ray tube.

In non-invasive imaging systems, X-ray tubes are used in fluoroscopy, projection X-ray, tomosynthesis, and computer tomography (CT) systems as a source of X-ray radiation. Typically, the X-ray tube includes a cathode and a target. A thermionic filament within the cathode emits a stream of electrons towards the target in response to heat resulting from an applied electrical current, with the electrons eventually impacting the target. A steering magnet assembly within the X-ray tube may control the size and location of the electron stream as it hits the target. Once the target is bombarded with the stream of electrons, it produces X-ray radiation.

The X-ray radiation traverses a subject of interest, such as a human patient or baggage, and a portion of the radiation impacts a detector or photographic plate where the image data is collected. In a medical diagnostic context, tissues that differentially absorb or attenuate the flow of X-ray photons through the subject of interest produce contrast in a resulting image. In some X-ray systems, the photographic plate is then developed to produce an image which may be used by a radiologist or attending physician for diagnostic purposes. In other contexts, parts, baggage, parcels, and other subjects may be imaged to assess their contents and for other purposes. In digital X-ray systems, a digital detector produces signals representative of the received X-ray radiation that impacts discrete pixel regions of a detector surface. The signals may then be processed to generate an image that may be displayed for review. In CT systems, a detector array, including a series of detector elements, produces similar signals through various positions as a gantry is displaced around a patient.

One method of imaging in CT systems includes dual energy imaging. In a dual energy application, data is acquired from an object using two operating voltages of an X-ray source to obtain two sets of measured intensity data using different X-ray spectra, which are representative of the X-ray flux that impinges on a detector element during a given exposure time. Since projection data sets corresponding to two separate energy spectra must be acquired, the operating voltage of the X-ray tube is typically switched rapidly so that the same anatomy is sampled at both high and low x-ray energy to prevent image degradation due to object motion.

For X-ray systems using the fast voltage switching methods as well as X-ray systems that have wobble capabilities, eddy currents may be induced into the beam pipe through which the electron beam passes, the core of the magnets used to steer the beam, and the windings of the steering magnet assembly. Such induction may slow response time for deflection of the electron stream, and thus may result in increased transition time and reduced exposure at a required power level. Accordingly, a need exists for improved response times within the steering magnet assembly.

BRIEF DESCRIPTION OF THE INVENTION

In one embodiment, an X-ray tube is provided. The X-ray tube includes an electron beam source, a target configured to generate X-rays when impacted by an electron beam from the electron beam source, and a steering magnet assembly disposed between the electron beam source and the target. The steering magnet assembly has a plurality of ferrite cores and a plurality of litz wire coils wound on the ferrite cores.

In another embodiment, a method for making an X-ray tube is provided. The method includes forming a steering magnet assembly comprising four substantially identical ferrite cores including two cathode side cores and two target side cores. Additionally, a plurality of cathode side quadrupole coils comprising litz wire is wound on the cathode side cores and coupled in series. Also, a plurality of target side quadrupole coils comprising litz wire is wound on the target side cores and coupled in series. The steering magnet assembly is disposed between an electron beam source and a target. Additionally, the coils are coupled to power supplies configured to switch current in the coils at a frequency of at least 100 kHz.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present embodiments are directed towards a system and method for enhancing response time of a steering magnet assembly. For example, in embodiments of an X-ray tube wherein the steering magnet assembly controls steering and wobble of an electron stream through the use of electromagnets, eddy currents induced into the beam pipe, magnet core, and magnet windings may be reduced by selecting an appropriate core material, selecting an appropriate material for the electromagnet coil windings, and defining proper positioning of the magnet poles with respect to the electron beam pipe. The reduction in eddy currents may considerably reduce the response time of the steering magnet assembly.

Figure 1:
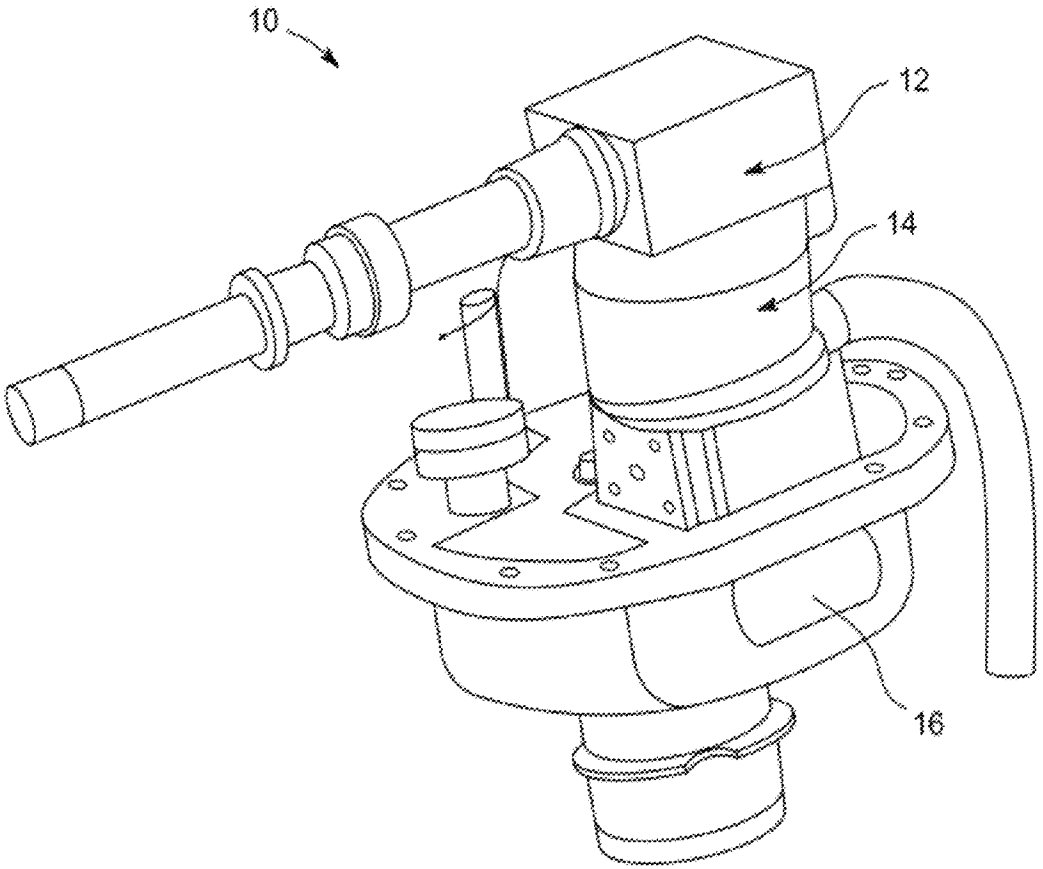
FIG. 1 is a perspective view of an X-ray tube, in accordance with an embodiment of the present invention.

The electromagnet steering techniques described herein may be utilized in an X-ray tube, such as X-ray tubes utilized in digital and photographic projection X-ray systems, fluoroscopy imaging systems, tomosynthesis imaging systems, CT imaging systems, and so on. FIG. 1 illustrates such an X-ray tube 10 for obtaining X-rays useful for imaging systems designed to acquire X-ray data, to reconstruct an image based upon the data, and to process the image data for display and analysis.

In the embodiment illustrated in FIG. 1, the X-ray tube 10 includes a cathode assembly. The cathode assembly 12 accelerates a stream of electrons through the X-ray tube 10, including through the steering magnet assembly 14, designed to control steering and size of the electron stream. The steering magnet assembly may include two sub-assemblies with multiple quadrupole and dipole magnets configured to provide steering and wobble capabilities for the stream of electrons within the X-ray tube 10. As a result of a collision of the electrons with a target within the X-ray tube 10, X-rays are produced. Focal X-ray radiation is emitted through the window 16, where it may be useful in obtaining X-ray imaging data.

Figure 2:
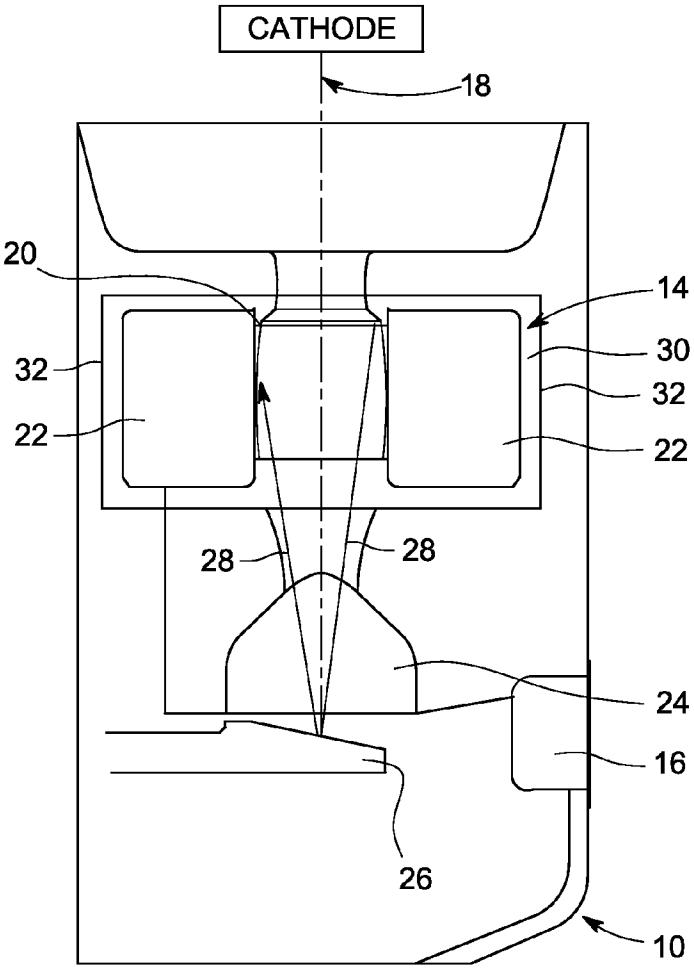
FIG. 2 is a cross-sectional side view of a portion of the X-ray tube depicted in FIG. 1.

FIG. 2 depicts a cross-sectional view of the X-ray tube embodiment of FIG. 1, in an effort to more clearly explain the current techniques. As previously discussed, cathode assembly 12 may accelerate an electron stream 18 through the X-ray tube 10. The electron stream 18 may pass through a throat, or electron beam pipe, 20 of the steering magnet assembly 14. As the electron stream 18 passes through the electron beam pipe 20, the steering magnet assembly 14 may provide electromagnetic fields through electromagnets 22, controlling the size and position of electron stream 18. Thus, the steering magnet assembly 14 provides for steering of the electron stream as well as the ability to quickly change the position of the electron stream, for wobble. The electromagnets 22 may be encased in epoxy, to create a path around the electron beam pipe 20 of the steering magnet assembly 14 as well as provide structural integrity for the steering magnet assembly 14. Next, the electron stream may pass through an electron collector 24 and collide with a target 26. The collision of the electron stream 18 with the target may result in some electrons or secondary radiation bouncing back into the beam pipe. As illustrated, the electron collector 24 may be disposed in facing relation to the target 26, allowing the electron collector 24 to capture and contain electrons and radiation that may be directed from the target 26 back into the electron collector 24. Focal X-ray radiation is produced and emitted through the window 16. Off-focal X-ray radiation 28 may be directed inwardly, back through the X-ray tube 10, reaching the steering magnet assembly 14. The off-focal X-ray radiation 28 may be attenuated by X-ray shielding materials. The steering magnet assembly 14 may obtain structural support by being in support base 30, which extends to exterior walls 32. The support base 30 may be designed to receive and couple magnetic sub-assemblies making up the steering magnet assembly 14.

Figure 3:
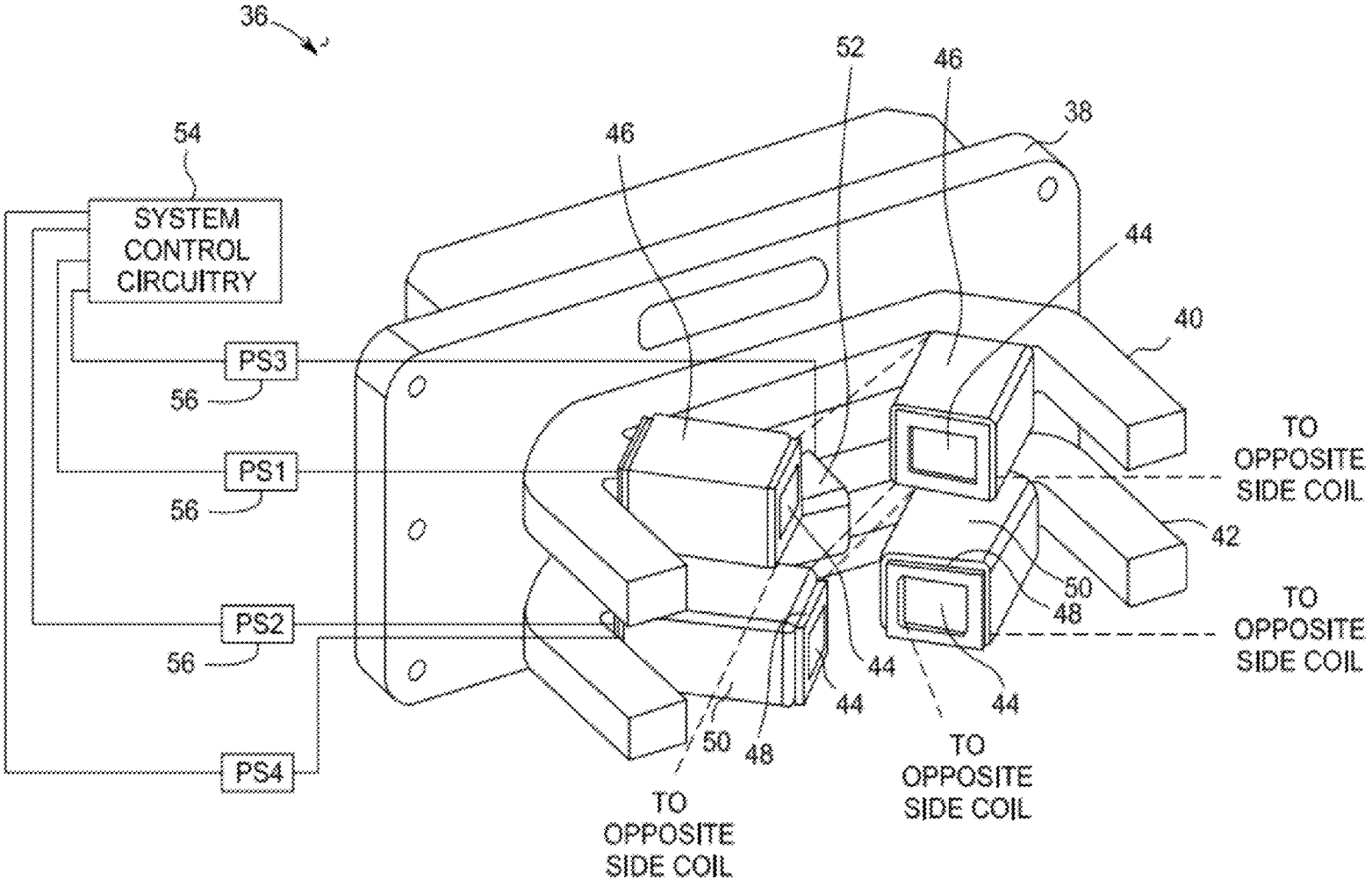
FIG. 3 is a perspective view of a steering magnet sub-assembly.

FIG. 3 illustrates an embodiment of one magnet subassembly 36, or one half of a full magnet assembly utilized in a steering magnet assembly 14. The full magnet assembly may consist of two substantially identical magnet subassemblies 36. The magnet subassembly 36 may include a frame 38, capable of uniting the various elements of the magnet assembly 36. The magnet subassembly 36 may include a plurality of cores (i.e., cathode side cores 40 and target side cores 42). The inventors have found that selecting an appropriate core material may have a considerable effect on steering response times within the steering magnet assembly 14. For example, core materials with lower permeability and higher bulk resistivity may reduce eddy currents in the core material, thus decreasing response time. Examples of such core materials may include ferrites. More specifically, the use of soft ferrites such as nickel zinc (Ni—Zn) or (Mn—Zn) may be warranted. The cathode side cores 40 and the target side cores 42 may include radial extensions 44, which may act as poles for the magnet subassembly 36.

The cathode side core 40 and the target side core 42 may include several coils created by winding wire around portions of the cathode side core 40 and target side core 42. By utilizing litz wire instead of solid conductors for the windings, inductance in the coils may be reduced, thus decreasing response time. As illustrated, the cathode side core may include litz wire coils formed along the radial extensions 44 of the cathode side core 40. Litz wire is made in different sizes with varying numbers of conductors within the wire. In a preferred embodiment, the litz wire may be approximately an 18 gauge wire and may include at least 100 conductors. The target side core 42 may also include a plurality of coils (i.e., inner target side quadrupole coils 48, outer target side quadrupole coils 50, and additional target side coils 52). The inner target side quadrupole coils 48 may be formed on the radial extensions 44 of the target side core 42. The outer target side quadrupole coils 50 may be formed over the inner target side quadrupole coils 48. Additional target side coils 52 may be formed on spans of the target side core 42. The dipole and quadrupole windings are formed on the same pole piece to make the assembly compact by utilizing the same poles for both focusing and deflection.

As previously mentioned, the magnet sub-assembly 36 depicted in FIG. 3 represents one half of the full magnet assembly. The other one half of the full magnet assembly may be substantially identical to magnet sub-assembly 36. Thus, the full magnet assembly, in accordance with the embodiment of magnet subassembly 36 of FIG. 3, may include two cathode side cores 40, two target side cores 42, eight radial extensions 44 (four on the cathode side cores 40 and four on the target side cores 42), four cathode side quadrupole coils 46, four inner target side quadrupole coils 48, four outer target side quadrupole coils 50, and two additional target side coils 52. The coils may be coupled in series based upon their groupings. For example, the cathode side quadrupole coils may be coupled in series by connecting the first coil with the second, the second with the third, and the third with the fourth. This coupling is represented by the dashed line in FIG. 3. Additionally, the inner target side quadrupole coils 48 may be coupled in series, the outer target side quadrupole coils 50 may be coupled in series, and the additional target side coils 52 may be coupled in series.

System control circuitry 54 may be coupled to a plurality of power supplies 56. The plurality of power supplies 56 may be coupled to each set of coils coupled in series. For example, as depicted in the embodiment of FIG. 3, a first power supply 56 may be coupled to the cathode side quadrupole coils 46, a second power supply 56 may be coupled to the inner target side quadrupole coils 48, a third power supply 56 may be coupled to the additional target side coils 52, and a forth power supply 56 may be coupled to the outer target side quadrupole coils 50. The system control circuitry may control current switching in the coils. In some embodiments, the current switching will be at a frequency of at least 1 kHz.

Figure 4:
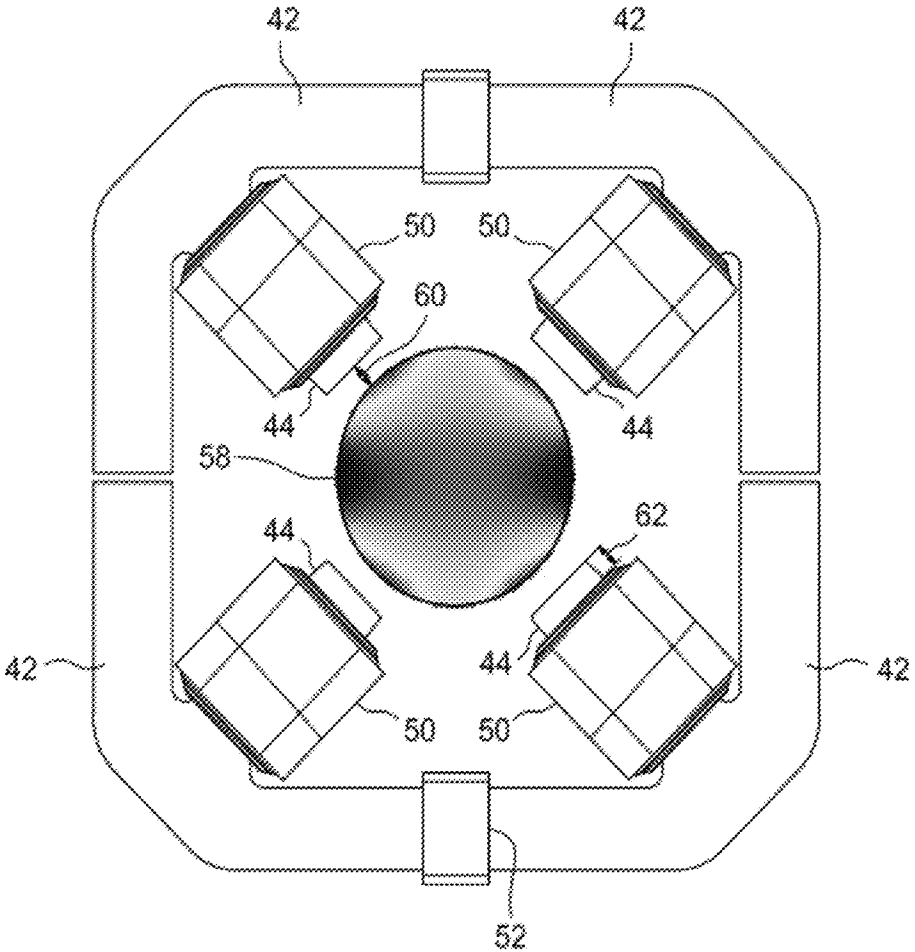
FIG. 4 is schematic illustration of the position of the beam pipe, magnetic poles, and the electromagnet coils within an X-ray tube.

As previously mentioned, proper positioning of the electromagnet poles (i.e., radial extensions 44) with respect to the electron beam pipe may further reduce response time within the steering magnet assembly 14. Enhanced magnetic field uniformity may be obtained by providing less spacing between the beam pipe diameter 58 and the cores (i.e., cathode side cores 40 and target side cores 42). Additionally field uniformity may be increased by extending the cores (i.e., cathode side cores 40 and target side cores 42) beyond the coils (i.e., cathode side quadrupole coils 46, inner target side quadrupole coils 48, outer target side quadrupole coils 50, and additional target side coils 52). FIG. 4 provides an illustration of positioning of the poles, coils and beam pipe, in accordance with an embodiment of the current techniques.

Depicted are the two target side cores 42, representing placement that would be achieved by coupling two magnet subassemblies 36. The target side cores 42 include radial extensions 44, acting as magnetic poles. As the distance 60 between the radial extensions 44 and the beam pipe diameter 58 decreases, the electromagnetic fields resulting from electrical current being supplied to the coils (i.e., outer target side quadrupole coils 50) may obtain increased coupling. While reducing distance 60 between the radial extensions 44 and the beam pipe diameter 58 creates increased coupling, it may not, in some embodiments, be feasible to obtain a distance of zero. Indeed, in some embodiments the cores (i.e., target side cores 42) may be encased in epoxy or other materials for structural support, cooling purposes, etc. In some embodiments, an example of a typical distance 60 between the radial extensions 44 and the beam pipe diameter may be less than 5 millimeters, leaving space around the pipe for oil/coolant circulation and for an epoxy encasment of the magnet assembly.

In addition to minimizing the distance 60 between radial extensions 44 and the beam pipe diameter 58, extending the distance 62 between the coils (i.e., the outer target side quadrupole coils 50) and the end of the radial extensions 42 may increase field uniformity, and thus increase effectiveness of the steering magnet assembly 14. The radial extensions 42 protrude substantially inward to reduce distance 60 and the coils are formed either flush with the face of the radial extensions 42 or further backwards, away from the beam pipe diameter 58, leaving distance 62.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray tube comprising:

an electron beam source;

a target configured to generate X-rays when impacted by an electron beam from the electron beam source, a steering magnet assembly disposed between the electron beam source and the target, the steering magnet assembly comprising a plurality of ferrite cores and a plurality of litz wire coils wound on the ferrite cores, and a plurality of power supplies configured to switch current in the coils at a frequency of at least 1 kHz.

2. The X-ray tube of claim 1, wherein the cores comprise radial extensions, at least one coil being wound on each radial extension, and wherein each radial extension extends radially inwardly beyond the respective coil.

3. The X-ray tube of claim 2, wherein each radial extension protrudes inward towards a beam pipe to within 5 millimeters of the beam pipe.

4. The X-ray tube of claim 2, wherein each radial extension protrudes radially inward towards a beam pipe and the coils are disposed at the edge portion of the radial extension closest to the beam pipe or are disposed at a portion of the radial extension further away from the beam pipe than the portion of the radial extension closest to the beam pipe.

5. The X-ray tube of claim 1, wherein the ferrite cores comprise a soft ferrite.

6. The X-ray tube of claim 5, the ferrite cores comprise nickel zinc or manganese zinc.

7. The X-ray tube of claim 1, comprising four substantially identical cores including two cathode side cores and two target side cores, and wherein the coils form cathode side quadrupole coils wound on the cathode side cores and coupled in series, and target side quadrupole coils wound on the target side cores and coupled in series.

8. The X-ray tube of claim 7, comprising additional coils wound over or under each target side quadrupole coil, the additional coils being coupled in series.

9. The X-ray tube of claim 8, comprising further coils wound on spans of target side cores and coupled in series.

10. The X-ray tube of claim 1, wherein the steering magnet assembly comprises two substantially identical subassemblies disposed on opposite sides of a passageway through which the electron beam travels during operation.

11. The X-ray tube of claim 1, wherein the litz wire comprises a composite size of approximately 18 gauge and at least 100 conductors.

12. An X-ray tube comprising:

an electron beam source;

a target configured to generate X-rays when impacted by an electron beam from the electron beam source, a steering magnet assembly disposed between the electron beam source and the target, the steering magnet assembly comprising four substantially identical ferrite cores including two cathode side cores and two target side cores, a plurality of cathode side quadrupole coils comprising litz wire wound on the cathode side cores and coupled in series, and a plurality of target side quadrupole coils comprising litz wire wound on the target side cores and coupled in series; and a plurality of power supplies configured to switch current in the coils at a frequency of at least 100 kHz.

13. The X-ray tube of claim 12, wherein the cores comprise radial extensions, at least one coil being wound on each radial extension, and wherein each radial extension extends radially inwardly beyond the respective coil.

14. The X-ray tube of claim 13, wherein each radial extension extends to within 5 millimeters of a central beam pipe diameter region.

15. The X-ray tube of claim 13, wherein each radial extension extends substantially radially inwardly, staying flush or extending beyond the respective coil.

16. The X-ray tube of claim 12, wherein the ferrite cores comprise a soft ferrite.

17. The X-ray tube of claim 16, the ferrite cores comprise nickel zinc or manganese zinc.

18. A method for making an X-ray tube, comprising:

forming a steering magnet assembly comprising four substantially identical ferrite cores including two cathode side cores and two target side cores, a plurality of cathode side quadrupole coils comprising litz wire wound on the cathode side cores and coupled in series, and a plurality of target side quadrupole coils comprising litz wire wound on the target side cores and coupled in series;

disposing the steering magnet assembly between an electron beam source and a target; and coupling the coils to power supplies configured to switch current in the coils at a frequency of at least 1 kHz.

19. The method of claim 18, the ferrite cores comprise nickel zinc or manganese zinc.

* * * * *